United States Patent [19]

Jones

[11] 4,339,294

[45] Jul. 13, 1982

[54] METHOD AND APPARATUS FOR MAKING REELED STRIP MATERIAL

[75] Inventor: Thomas S. Jones, Billericay, England

[73] Assignee: Ciba-Geigy AG, Basel, Switzerland

[21] Appl. No.: 214,943

[22] Filed: Dec. 10, 1980

[30] Foreign Application Priority Data

Dec. 19, 1979 [GB] United Kingdom ..... 7943707

[51] Int. Cl.[3] ..... B32B 31/18

[52] U.S. Cl. ..... 156/252; 156/259; 156/263; 156/290; 156/514; 206/389; 206/400; 430/501

[58] Field of Search ..... 156/157, 159, 184, 185, 156/186, 191, 252, 259, 263, 290, 514; 206/389, 397, 398, 400, 411, 412, 824; 430/501

[56] References Cited

U.S. PATENT DOCUMENTS

| | | | |
|---|---|---|---|
| 1,905,446 | 4/1933 | Dewey et al. . | |
| 2,384,657 | 9/1945 | Tyler | 430/501 |
| 3,022,170 | 2/1962 | Flinchbaugh et al. | 96/78 |
| 3,909,330 | 9/1975 | Schmermund | 156/514 |
| 3,986,879 | 10/1976 | Klinkhammer | 430/501 |
| 4,189,339 | 2/1980 | Loeffler et al. | 156/263 |

FOREIGN PATENT DOCUMENTS

| | | |
|---|---|---|
| 2228701 | 12/1974 | France . |
| 55-277 | 1/1980 | Japan . |

*Primary Examiner*—Caleb Weston
*Attorney, Agent, or Firm*—Harry Falber

[57] ABSTRACT

There is described a method of preparing reeled slit web material which comprises transporting a web of material past a punching station and punching a series of holes across the width of the web. Then applying across the web material a strip of material covered with pressure sensitive adhesive which adheres to the web material so that all the punched holes are covered by the applied material, passing the web material to a slitting machine which slits the web into strips so that each strip contains a covered punched hole with the covering on the outer side of the strip as it is reeled up. Each strip is then cut so that a covered punched hole or slot is at or close to either the leading end or the trailing end of each strip, then when the punched hole or slot is close to the leading end of the strip leading each strip to a reeling core and pressing down the leading end on the core so that the pressure sensitive adhesive adheres thereto through the punched hole or slot and secures the strip to the core and reeling up the strip on the core. When the punched hole or slot is at or close to the trailing end of each strip reeling the strip on to the core until all the strip is wound on the core and then pressing down the trailing end of the strip on the underlying turn of material so that pressure sensitive adhesive adheres thereto through the punched hole or slot and secures the trailing end of the strip to the reeled strip.

Preferably the strip of material covered on one side with pressure sensitive adhesive has across its surface a series of alphanumeric characters so spaced that when the web is slit an alphanumeric character is present on each strip of slit material.

6 Claims, 3 Drawing Figures

METHOD AND APPARATUS FOR MAKING REELED STRIP MATERIAL

This invention relates to the slitting and reeling of web material.

Web material is often coated or otherwise treated as widths up to 1.5 meters wide and then slit into strips often no wider than 16 mm. These strips are then usually reeled up on a core for ease of transportation. Generally it is required that the trailing end of the strip of web material is fastened down on the underlying turn of web in the reel to prevent the coiled reel from becoming uncoiled. Often the trailing end of such web strips is secured by the use of pressure sensitive adhesive tape. But it is very time consuming to apply manually a piece of tape to each reeled strip if, for example, a 1.45 meter width of web is slit into 89 strips. Furthermore it is difficult to carry out such an operation automatically. A similar difficulty arises in trying to secure the leading end of each strip to the core on which the strip is reeled.

According to the present invention there is provided a method of preparing reeled slit web material which comprises transporting a web of material past a punching station and punching a series of holes across the width of the web, then applying across the web material a strip of material covered with pressure sensitive adhesive which adheres to the web material so that all the punched holes are covered by the applied material, passing the web material to a slitting machine which slits the web into strips so that each strip contains a covered punched hole with the covering on the outer side of the strip as it is reeled up, cutting each strip so that a covered punched hole or slot is at or close to either the leading end or the trailing end of each strip, then when the punched hole or slot is close to the leading end of the strip leading each strip to a reeling core and pressing down the leading end on the core so that the pressure sensitive adhesive adheres thereto through the punched hole or slot and secures the strip to the core and reeling up the strip on the core and/or when the punched hole or slot is at or close to the trailing end of each strip reeling the strip on to the core until all the strip is wound on the core and then pressing down the trailing end of the strip on the underlying turn of material so that pressure sensitive adhesive adheres thereto through the punched hole or slot and secures the trailing end of the strip to the reeled strip. As noted, for purposes of this invention the term "hole" is meant to apply equally to a slot configuration.

Preferably two series of holes are punched across the width of the web close together so forming a covered punched hole at the leading end of each strip and at the trailing end of each strip. However a series of elongated holes may be punched across the width of the web, this elongated hole being covered with the pressure sensitive adhesive material and after slitting being cut through the elongated hole thus providing a covered slot at the trailing end of one strip and the leading end of the following strip.

Preferably when two series of holes are punched across the width of the web each punched hole is elongated along the length of the strip and most preferably is at least as long as the width of the strip. Also preferably the width of the punched hole is between $\frac{1}{4}$ and $\frac{3}{4}$ of the width of the strip.

Preferably the strip of material covered on one side with pressure sensitive adhesive which is applied to the web material has across its surface a series of alphanumeric characters so spaced that when the web is slit an alphanumeric character is present on each strip of slit material. This provides an effective method of numbering reels of slit material. Alternatively bar code means can be used.

According to another feature of the present invention there is provided apparatus for preparing reeled slit web material which comprises means for transporting the web material through the apparatus, means for punching a series of holes across the web material, means for applying a strip of material covered on one side with pressure sensitive adhesive to the web so that all the punched holes are covered by the strip, slitting means to slit the web into strips each containing a covered punched hole, reeling means to reel up each slit strip, cutting means to cut each strip at or close to the covered punched hole so that a punched hole or slot is present at the trailing end of each strip and at or close to the leading end of each strip, and means to press down the trailing end of the strip on to the reeled strip and means to press down the leading end of each strip on a core.

Preferably each pressing means is covered with resilient material to help the adhesive to come into close contact with the core through the punched hole.

Usually it is possible to use the same means to press down the leading ends and the trailing ends of the strips to secure them either on the core or on the underlying turn of slit web.

When two series of holes are punched across the width of the web it is possible to use one punching means, however preferably two punching means are employed simultaneously to ensure the correct spacing between the two series of holes.

Most preferably the pressure sensitive adhesive material applied to the web is sufficiently wide to cover both series of holes punched across the web so that when the strip is cut one hole is in the trailing end of the strip and the other hole is in the leading end of the next strip.

Most preferably the pressure sensitive adhesive material is a metal foil tape. This metal foil can be used to activate the cutting means.

It is to be understood that both edges of web material are often knurled and thus the two edge slits even though they may be reeled up are of no use. Therefore it is not necessary that a covered punched hole is present in these edge slits.

The invention is of particular use in the preparation of reeled photographic film material. Some photographic film material is perforated along one or both edges after it has been slit and before reeling and provision in such cases may be made for a perforator to be present between the slitting means and the reeling means. However such perforated holes when covered with adhesive tape are too small to allow sufficient adhesive effect to be applied therethrough to secure the strips to the core or to the underlying web.

The accompanying drawings will serve to illustrate the invention.

In all the Figures the same numbers have the same signification.

Figure 1:
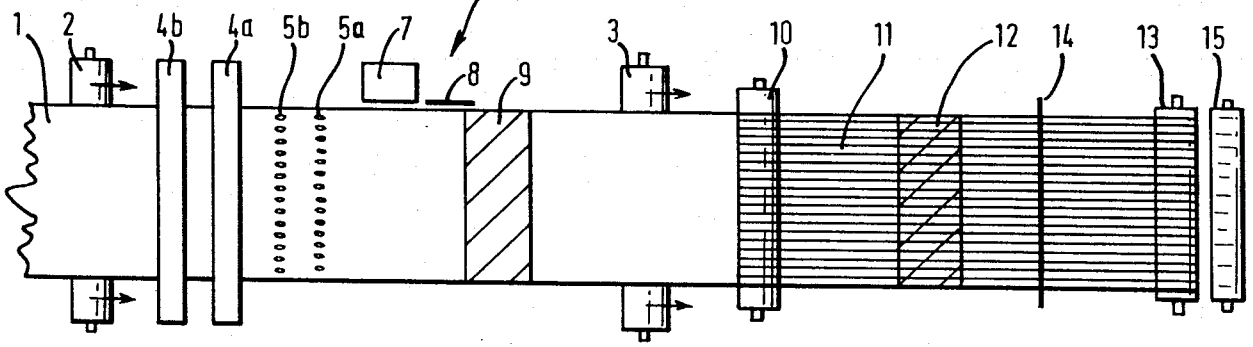
FIG. 1 is a top plan view of a diagrammatic layout of the apparatus used in the method of the present invention.

In the drawings a web 1 of photographic film material coated with a photosensitive gelatin emulsion layer is being caused to travel through the apparatus by being partially lapped around rotating driving rollers 2 and 3. The driven web 1 passes under punches 4*a* and 4*b* and two series of punched holes 5*a* and 5*b* are formed in the web 1. The web 1 then passes a strip applying station 6 which comprises a reel 7 of pressure sensitive adhesive material which is applied on to the web across the lines of punched holes 5*a* and 5*b*. The strip of pressure sensitive adhesive material after application to the web is cut by knife 8, leaving on the film web over the punched holes a strip 9 of pressure sensitive adhesive material with the adhesive side lying on the web.

The web 1 bearing the strip 9 of pressure sensitive adhesive material is then advanced to a slitter 10 which slits the web into strips 11 each of which has therein two punched holes covered with a short strip of adhesive material 12. Each of the strips 11 is fed on to a core 13. A cutter 14 cuts each strip between hole 5*a* and 5*b*. As the trailing edge of each strip which contains hole 5*a* is reeled on to the core 13 rollers 15 press against this trailing edge and cause this end to adhere to the reel of material.

The leading ends of the next strips which contain holes 5*b* are then fed on to new cores 13. Rollers 15 press against this leading end and cause the leading end to adhere firmly to the core 13. The strip is then reeled up on this core until sufficient has been reeled.

Figure 2:
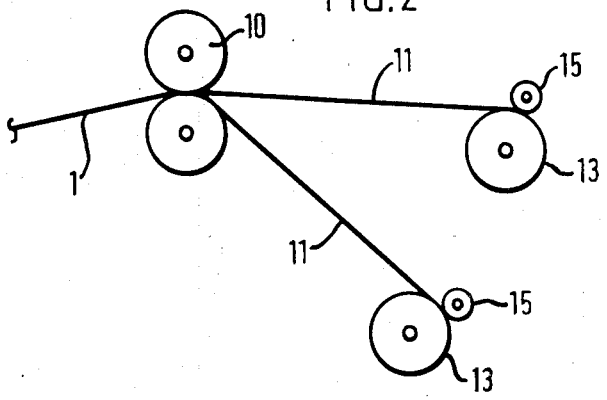
FIG. 2 is a side view of part of the layout of FIG. 1.

In FIG. 2 is shown in side elevation a slitter and the core 13 with the pressing rollers 15. In practice as each edge of the strips has a bevelled edge it is preferred to reel up the strips at different alternate levels as shown in this figure.

Figure 3:
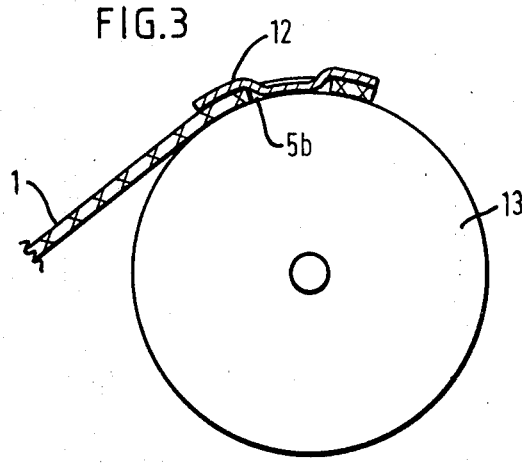
FIG. 3 is an enlarged view of the leading end of a strip secured to a reeling core.

In FIG. 3 the leading end of a strip 11 of film has therein a punched hole 5*b* which is covered with a short strip of adhesive tape 12. The centre part of this tape is shown pushed through the hole to adhere to the core 13.

Roller 15 is covered with sponge rubber to facilitate the tape coming into close contact with the surface of the core.

In one apparatus a web of film material 1.45 meters wide is slit into 89 useful strips which are reeled up individually on to driven cores 13. The distance between the punch 4*a* and the driven cores 13 is 1 meter. It is required to reel up 30 meters of film material onto each core.

In operation the web 1 of material is fed through the apparatus by the rollers 2 and 3. The individual strips 11 of film material are then led automatically on to driven cores 13 and the leading end pressed down on the cores. Only punch 4*a* is caused to operate as only one hole is required at the commencement of operations. The web is progressed through the apparatus and the number of rotations of each core is recorded and when this number indicates that 29 meters of film material have been reeled on to the core 13 the punches 4*a* and 4*b* are actuated to produce the rows of punched holes 5*a* and 5*b*. Then as these rows approach the strip applying station 6 a strip of pressure sensitive adhesive material is applied to the web 1 over the rows of punched holes 5*a* and 5*b* and trimmed off by knife 8. The web 1 carrying the strip then passes through the slitter 10 and when each strip 11 bearing the short strip 12 of pressure sensitive adhesive material passes the cutter 14 each strip is cut between the holes 5*a* and 5*b* leaving a covered hole close to the leading end and the trailing end of each strip being wound on to the cores 13 and the rollers 2 and 3 are stopped, thus stopping the web from advancing through the apparatus. When the trailing ends have been wound on to the cores 13 rollers 15 press each trailing end firmly on to the underlying turn of film material on the core. This activates the pressure sensitive adhesive through the punched holes and causes the trailing end to adhere to the roll of film material.

Each core 13 is then removed from the apparatus and fresh cores inserted. The rollers 2 and 3 are restarted and strips 11 are fed automatically on to the cores 13 which are then rotated and the leading ends are pressed down to adhere to the cores by the rollers 15 and 29 meters of slit film are then fed on to the core. The punching, covering and slitting operation is then repeated.

I claim:

1. A method of preparing reeled slit web material which comprises transporting a web of material past a punching station and punching a series of holes or slots across the width of the web, then applying across the web material a strip of material covered with pressure sensitive adhesive which adheres to the web material so that all the punched holes or slots are covered by the applied material, passing the web material to a slitting machine which slits the web into strips so that each strip contains a covered punched hole or slot with the covering on the outer side of the strip as it is reeled up, cutting each strip so that a covered punched hole or slot is at or close to either the leading end or the trailing end of each strip, then when the punched hole or slot is close to the leading end of the strip leading each strip to a reeling core and pressing down the leading end on the core so that the pressure sensitive adhesive adheres thereto through the punched hole or slot and secures the strip to the core and reeling up the strip on the core and/or when the punched hole or slot is at or close to the trailing end of each strip reeling the strip on to the core until all the strip is wound on the core and then pressing down the trailing end of the strip on the underlying turn of material so that pressure sensitive adhesive adheres thereto through the punched hole or slot and secures the trailing end of the strip to the reeled strip.

2. A method according to claim 1 wherein the strip of material covered on one side with pressure sensitive adhesive which is applied to the web material has across its surface a series of alphanumeric characters so spaced that when the web is slit an alphanumeric character is present on each strip of slit material.

3. A method according to claim 1 or claim 2 wherein the pressure sensitive adhesive material is metal foil tape covered on one side with pressure sensitive adhesive.

4. A method according to any one of claims 1 to 3 wherein two series of holes are punched across the web in close proximity and the pressure sensitive adhesive material is sufficiently wide to cover both series of holes.

5. Apparatus for preparing reeled slit web material which comprises means for transporting the web material through the apparatus, means for punching a series of holes or slots across the web material, means for applying a strip of material covered on one side with pressure sensitive adhesive to the web so that all the punched holes or slots are covered by the strip, slitting means to slit the web into strips each containing a covered punched hole or slot, reeling means to reel up each slit strip, cutting means to cut each strip at or close to the covered punched hole or slot so that a punched hole or slot is present on the trailing end of each strip and at or close to the leading end of each strip, and means to press down the trailing end of the strip on to the reeled strip and means to press down the leading end of each strip on a core.

6. Apparatus according to claim 5 wherein each pressing means is covered with resilient material.

* * * * *